US007997039B2

(12) United States Patent
Wolf et al.

(10) Patent No.: US 7,997,039 B2
(45) Date of Patent: Aug. 16, 2011

(54) VENEER PANEL

(75) Inventors: David H. Wolf, Newark, OH (US); Harold C. Attebery, II, Granville, OH (US); Jeff Klotz, Newark, OH (US); James J. Dottavio, Granville, OH (US); David C. Hines, Swanton, OH (US); Joy M. Justice, Columbus, OH (US); Josh Broehl, Worthington, OH (US); Zach Simmering, Mansfield, OH (US)

(73) Assignee: Boral Stone Products, LLC, Roswell, GA (US)

( * ) Notice: Subject to any disclaimer, the term of this patent is extended or adjusted under 35 U.S.C. 154(b) by 1186 days.

(21) Appl. No.: 11/647,751

(22) Filed: Dec. 29, 2006

(65) Prior Publication Data

US 2008/0155921 A1 Jul. 3, 2008

(51) Int. Cl.
*E04F 13/00* (2006.01)
*E04C 2/00* (2006.01)

(52) U.S. Cl. ..... 52/314; 52/443; 52/446; 52/105; 52/302.1; 52/555

(58) Field of Classification Search ..... 52/105, 52/314–316, 344, 443, 444, 446, 449, 453, 52/796.1, 302.1, 555
See application file for complete search history.

(56) References Cited

U.S. PATENT DOCUMENTS 1,592,591 A * 7/1926 James ..... 264/34
1,853,822 A * 4/1932 Joseph Krauss ..... 52/314
1,853,824 A * 4/1932 Joseph Krauss ..... 52/314
1,976,947 A 10/1934 Krauss
2,006,635 A * 7/1935 Farr ..... 52/314
2,031,680 A * 2/1936 Lloyd ..... 52/387
2,198,466 A * 4/1940 Stolze ..... 52/385
2,209,283 A * 7/1940 Ronzone ..... 52/314
D135,475 S 4/1943 Wright
D135,476 S 4/1943 Wright
2,329,610 A * 9/1943 Harman ..... 52/388
3,177,279 A 4/1965 Bilodeau
3,248,834 A * 5/1966 Charles ..... 52/316
3,332,187 A 7/1967 Arcari
3,344,011 A * 9/1967 Murray ..... 428/67
3,350,827 A 11/1967 Sugar
3,524,790 A 8/1970 Mason
3,533,206 A * 10/1970 Passeno, Jr. ..... 52/387
3,613,326 A 10/1971 Mollman
3,621,625 A * 11/1971 Medow ..... 52/314
(Continued)

FOREIGN PATENT DOCUMENTS

GB 444503 3/1936
(Continued)

OTHER PUBLICATIONS

International Search Report dated Apr. 21, 2008 in PCT/US2007/025532.

*Primary Examiner* — Robert Canfield
(74) *Attorney, Agent, or Firm* — Alston & Bird LLP

(57) ABSTRACT

A cast veneer wall panel includes a facing panel having at least one design element. The facing panel is made from a cast material. In addition the wall panel includes a backing panel including a series of spaced apertures. The series of spaced apertures receive a portion of the cast material in order to key the facing panel and the backing panel together.

19 Claims, 2 Drawing Sheets

U.S. PATENT DOCUMENTS

| | | | | | |
|---|---|---|---|---|---|
| 3,646,715 | A | | 3/1972 | Pope | |
| 3,701,228 | A | | 10/1972 | Taylor | |
| 3,740,910 | A | | 6/1973 | Taylor et al. | |
| 3,908,326 | A | | 9/1975 | Francis | |
| 3,968,610 | A | | 7/1976 | Medow | |
| 4,026,083 | A | | 5/1977 | Hoyt et al. | |
| 4,219,984 | A | | 9/1980 | de San | |
| 4,271,111 | A | | 6/1981 | Sheber | |
| 4,299,069 | A | | 11/1981 | Neumann | |
| 4,407,104 | A | | 10/1983 | Francis | |
| 4,468,903 | A | * | 9/1984 | Eaton et al. | 52/105 |
| 4,495,738 | A | | 1/1985 | Sheber | |
| 4,644,719 | A | | 2/1987 | Salazar | |
| 4,665,673 | A | | 5/1987 | Diana | |
| 4,773,201 | A | * | 9/1988 | Trezza | 52/510 |
| 4,858,410 | A | * | 8/1989 | Goldman | 52/591.5 |
| 4,932,182 | A | * | 6/1990 | Thomasson | 52/318 |
| 5,052,161 | A | | 10/1991 | Whitacre | |
| 5,228,937 | A | | 7/1993 | Passeno | |
| 5,232,646 | A | | 8/1993 | Nasvik et al. | |
| 5,311,714 | A | | 5/1994 | Passeno | |
| 5,540,023 | A | * | 7/1996 | Jaenson | 52/343 |
| 5,787,666 | A | | 8/1998 | Sherry | |
| 5,916,103 | A | * | 6/1999 | Roberts | 52/552 |
| 6,151,854 | A | | 11/2000 | Gutjahr | |
| 6,237,288 | B1 | * | 5/2001 | Jenkins et al. | 52/105 |
| 6,355,193 | B1 | | 3/2002 | Stott | |
| 6,408,585 | B1 | | 6/2002 | Tajima | |
| 6,516,578 | B1 | | 2/2003 | Hunsaker | |
| D497,013 | S | | 10/2004 | Hughes | |
| 6,802,165 | B1 | | 10/2004 | Passeno | |
| 6,830,405 | B2 | | 12/2004 | Watanabe | |
| 6,857,248 | B2 | | 2/2005 | Ouellet et al. | |
| D510,146 | S | | 9/2005 | Attebery, II et al. | |
| 6,951,086 | B2 | | 10/2005 | Passeno | |
| 6,973,756 | B2 | | 12/2005 | Hatzinikolas | |
| 6,990,778 | B2 | | 1/2006 | Passeno | |
| RE39,091 | E | | 5/2006 | Kuelker | |
| 7,617,647 | B2 | * | 11/2009 | Turner et al. | 52/385 |
| 2003/0066259 | A1 | | 4/2003 | Sudweeks | |
| 2004/0107663 | A1 | * | 6/2004 | Waggoner | 52/518 |
| 2005/0188642 | A1 | | 9/2005 | Correia | |
| 2005/0210811 | A1 | | 9/2005 | Nasvik | |
| 2005/0257475 | A1 | | 11/2005 | Gong et al. | |
| 2007/0022687 | A1 | | 2/2007 | Correia | |
| 2007/0137128 | A1 | | 6/2007 | Viau et al. | |
| 2009/0049765 | A1 | * | 2/2009 | Grant | 52/105 |
| 2009/0193742 | A1 | * | 8/2009 | Wolf et al. | 52/311.1 |
| 2009/0249719 | A1 | * | 10/2009 | Broehl et al. | 52/250 |

FOREIGN PATENT DOCUMENTS

| | | |
|---|---|---|
| WO | WO 2006/042883 | 4/2006 |

* cited by examiner

VENEER PANEL

TECHNICAL FIELD AND INDUSTRIAL APPLICABILITY OF THE PRESENT INVENTION

This invention relates generally to the construction field and, more particularly, to a veneer panel, more particularly to a cast veneer wall panel, and includes a backing panel for a cast veneer wall panel and a method of making a cast veneer wall panel.

BACKGROUND OF THE INVENTION

Veneer panels have been developed as a quick and efficient way to provide a masonry appearance for a building while simplifying construction and lowering construction costs. Such panels typically include a substrate having a series of discrete design or masonry elements attached thereto. Examples are shown in U.S. Pat. Nos. 3,740,910, 6,516,578, and 6,990,778, which are incorporated herein by reference in their entirety. In such panel constructions, discrete thin bricks are manufactured, then attached to a substrate (such as fiberboard, foam or steel), the assembly then being attached to a wall. These design elements simulate brick, stone, tile and other masonry building components or materials commonly used in the construction of buildings. These panels are relatively expensive to manufacture, as one must first make the veneer product and the substrate, then utilize labor to attach the veneer to the substrate, then attaching the assembly to the structure. Additionally, some such products have potential issues with the attachment system and the finished appearance.

Examples of cast veneer wall panels are disclosed in U.S. Pat. No. 3,332,187 (Arcari) and U.S. Pat. No. 4,644,719 (Salazar), which are incorporated herein by reference in their entirety. Arcari '187 utilizes a matched mold wherein a first pour is required to get ½ of the veneer thickness; whereafter a mesh is placed on the first pour; and a matched mold is then laid over the mesh, while a second pour creates the back half of the veneer. This creates a lot of manufacturing complexity and does not achieve acceptable product properties. Salazar '719 creates a panel using a continuous fiber reinforced base and an unreinforced veneer attached to the base. Like the previously mentioned processes, this creates manufacturing complexity and waste, plus does not achieve the desired properties for the veneer panel.

Another simulated veneer panel is described in U.S. Pat. No. 3,177,279, which creates a polymer panel to simulate a veneer texture. These products are typically unattractive in appearance and do not have the properties desired in a veneer product. Cast veneer wall panels are typically made from reinforced construction materials such as fiberglass reinforced concrete.

Monolithic cast veneer wall panels made from such reinforced materials have been produced which are more resistant to damage from handling during packaging, shipping and installation. Such designs suffer from the cost, weight and aesthetics being typically unacceptable. Further improvements in durability to reduce loss due to breakage are still desired. As noted above, prior panels particularly fail to closely resemble real brick or stone veneer. The present invention relates to a cast veneer wall panel of enhanced durability providing significantly improved handling characteristics due to light weight construction and ability to fasten by nailing, and which has an appearance closely resembling real brick or stone veneer.

SUMMARY OF THE INVENTION

In accordance with the purposes of the present invention as described herein, an improved veneer panel is provided. The cast veneer wall panel preferably comprises a facing panel preferably made from a cast material. The facing panel includes at least one design element such as a simulated stone, brick or tile. Typically the facing panel includes multiple design elements at spaced locations. In addition, the cast veneer wall panel includes a backing panel preferably having a series of spaced apertures. The spaced apertures preferably receive a portion of the cast material used to make the facing panel in order to key the facing panel and backing panel together.

The cast material may be selected from a group of materials consisting of concrete and fiber reinforced concrete, gypsum, other reinforced cementitious materials and mixtures thereof where fibers are preferably utilized to reinforce the concrete. Preferred fibers may be selected from a group of materials including but not limited to glass fibers, mineral fibers, natural fibers, man-made fibers, such as polymer fibers, and mixtures thereof. Where glass fibers are used the fibers are typically of the E-glass, C-glass, R-glass, S-glass, ECR-glass or AR-glass types. Exemplary polymer fibers include those described in U.S. Pat. No. 6,844,065, which is incorporated herein by reference in its entirety.

The backing panel preferably also includes at least one concavity that nests within each design element. At least one aperture of the series of spaced apertures is provided in the concavity. In addition, the backing panel includes a mounting flange projecting beyond an edge of the facing panel. The mounting flange may be divided into identifiable zones including, for example, a "no nail" zone.

Still further describing the invention the facing panel includes a mortar bed area adjacent each of the design elements. Further, the backing panel preferably includes a second flange in addition to the mounting flange. The second flange corresponds in width to the mortar bed area provided between the design elements. Still further, the backing panel includes a front fact and a rear face. The front face preferably engages the facing panel. In one possible embodiment the backing panel includes at least one stiffening rib on the rear face. In another possible embodiment the backing panel includes a series of spaced dimples projecting from the rear face.

Still further describing the invention the cast veneer wall panel may include a registration mark on at least one of the facing panel and the backing panel. The registration marks allow the installer to quickly and easily align the cast veneer wall panels so that the design elements on those panels are properly oriented and aligned to simulate top quality masonry construction.

The backing panel of the cast veneer wall panel may be made from metal (reinforced or unreinforced), wood or plastic including a polymer material, composite material, natural materials or mixtures thereof. The polymer material may preferably be selected from a group consisting of polyvinyl chloride, polypropylene, polyethylene, polyamide, epoxy, vinyl ester, polyester and mixtures thereof. The composite material includes (a) a reinforcing material selected from a group preferably including mineral fibers (such as basalt, metal, glass or ceramic), other man made fibers such as glass fibers (such as E-glass fibers, C-glass fibers, R-glass fibers, S-glass fibers, ECR-glass fibers, AR-glass fibers), carbon fibers, natural fibers, such as cellulose fibers (such as bast-including kenaf, jute, hemp, etc), and mixtures thereof and (b) a matrix binder selected from a group consisting of polyvinyl chloride, polypropylene, polyethylene, polyamide, epoxy, vinyl ester, polyester and mixtures thereof. One skilled in the art appreciates that foregoing lists are not meant to be exhaustive.

In accordance with still another aspect of the present invention a backing panel is provided for a cast veneer wall panel. The backing panel comprises a body having a main section and a mounting flange. The main section preferably includes a series of spaced apertures as described above to allow the backing panel to be keyed to the facing panel that includes the design or masonry elements.

More specifically, the backing panel preferably includes at least one concavity in the main body. At least one aperture of the series of spaced apertures is provided in the concavity. Further the body includes a front face and a rear face. The rear face may include at least one stiffening rib. Alternatively, the rear face may include a series of spaced dimples.

In accordance with still another aspect of the present invention a method is provided for making a cast veneer wall panel. The method comprises the steps of adding the casting material to a product mold, positioning a backing panel on the casting material prior to the setting of the casting material and removing the wall panel from said mold. The method may further include the step of pressing the backing panel into the casting material so as to force some casting material into a keying aperture provided in the backing panel.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of this specification, illustrate several aspects of the present invention and together with the description serve to explain certain principles of the invention. In the drawings.

Reference will now be made in detail to the present preferred embodiments of the invention, examples of which are illustrated in the accompanying drawings.

DETAILED DESCRIPTION OF THE PREFERRED EMBODIMENTS OF THE INVENTION

Figure 1:
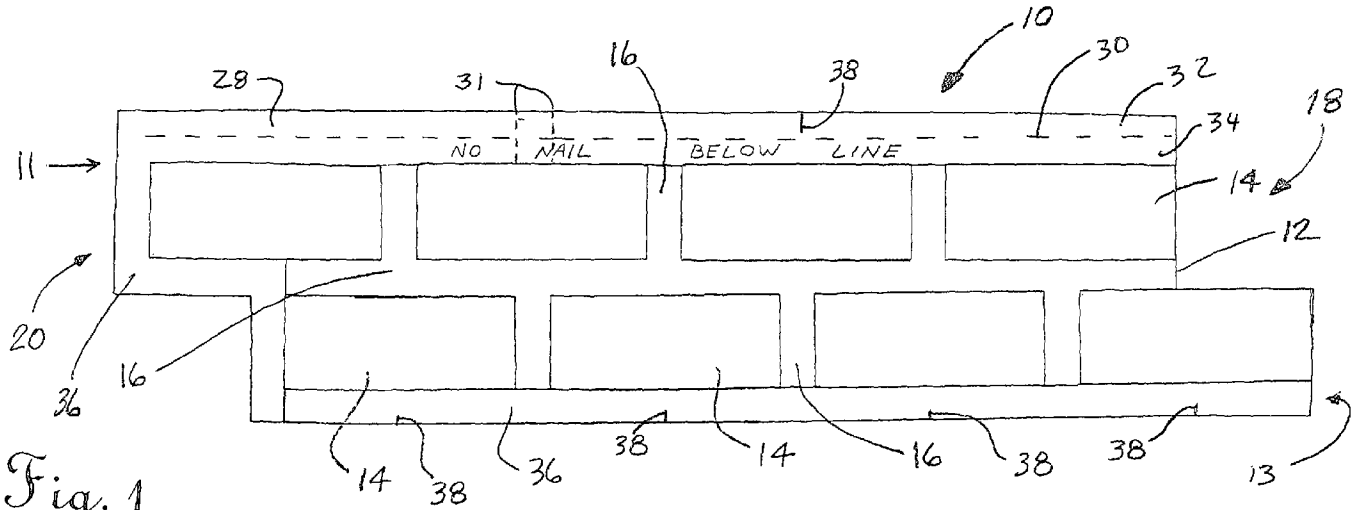
FIG. 1 is a front plan view of a veneer panel of the present invention.
Figure 4:
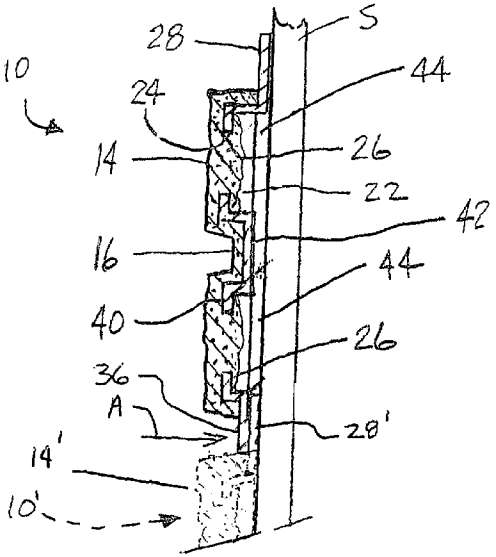
FIG. 4 is a cross sectional view through line 2-2 of FIG. 2.

Reference is now made to FIG. 1 illustrating the front face of a veneer panel 10 of the present invention. As illustrated, a veneer wall panel 10 preferably comprises a facing plate 18, including a base plate 12 and a series of masonry or design elements 14. The design elements 14 project outwardly from the base plate 12 (see also FIG. 4). The base plate 12 need not be a separate construction from the design elements 14, but in a preferred embodiment (as illustrated) is provided in a separate plane. In the illustrated embodiment, the design elements 14 are simulated bricks aligned in a regimented pattern in accordance with standard masonry practices. The base plate between the design elements preferably forms a mortar bed area 16. As illustrated in FIG. 4, the base plate 12 and design elements 14 may be made from the same material, or may be made from different materials, or a combination of the two. Alternatively, the veneer may be a dry stack without a mortar bed per se. While illustrated as multiple design elements 14 and a flat panel 10, one skilled in the art appreciates that while not illustrated or described in detail, the instant invention could comprise a single design element and/or any shape, such as a corner, a column (partial or complete), or any other useful shape.

Where constructing a veneer with the mortar bed area 16, such a panel may be grouted by positioning mortar between the design elements 14 so as to provide a finished masonry appearance. In a preferred embodiment, the panel is grouted at the jobsite by installing mortar after the panel is installed, as described in commonly assigned U.S. patent application Ser. No. 11/647,679 to Attebery, entitled "Fiber Reinforced Concrete Stone Panel System" filed concurrently herewith, which is incorporated herein by reference in its entirety ("Attebery"). While the design elements 14 illustrated in the drawing figure correspond to simulated bricks, it should be appreciated that substantially any other masonry material known in the art may be simulated including bricks of different sizes, stones of different shapes and sizes, tiles of different shapes and sizes and the like.

The base plate 12 is preferably made from a cast or molded material such as concrete, reinforced concrete, gypsum, reinforced cementitious material, polymeric material (reinforced or unreinforced), metal and mixtures thereof. Typically the cast material includes reinforcements comprising fibers selected from a group of materials consisting of glass fibers, mineral fibers, natural fibers, polymer fibers and mixtures thereof as described above. Where glass fibers are used, they are typically of the E-glass or AR-glass type which exhibits some alkali resistance.

Figure 2:
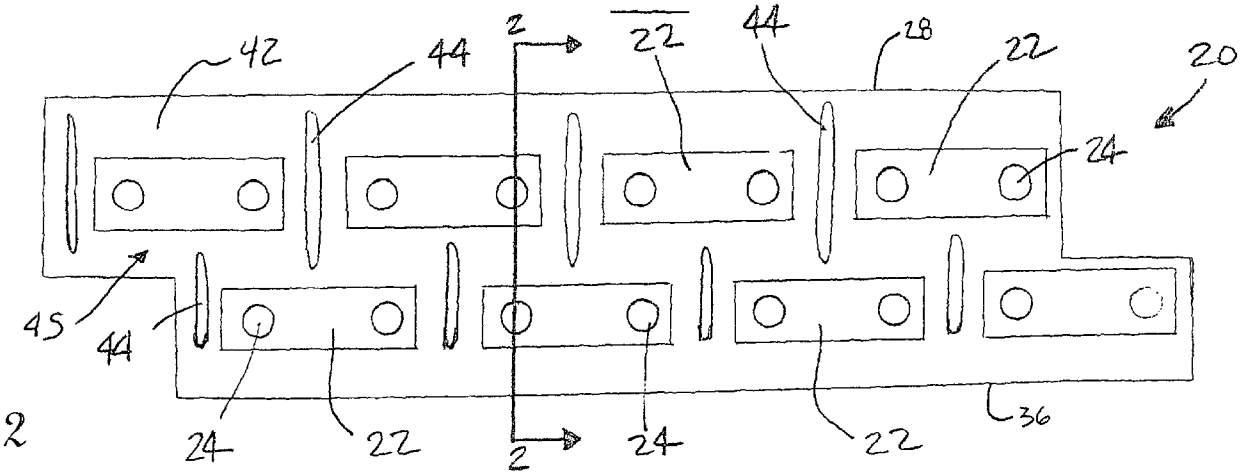
FIG. 2 is a rear plan view of one possible embodiment of a cast veneer wall panel of the present invention.
Figure 3:
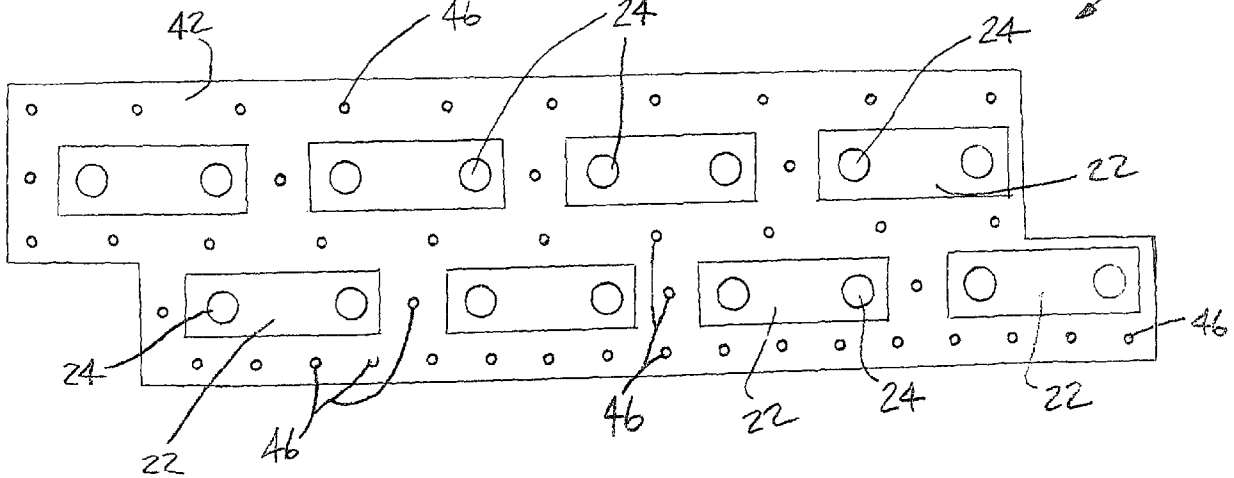
FIG. 3 is a rear plan view of another possible embodiment of a cast veneer wall panel of the present invention.

The cast veneer wall panel 10 also comprises a backing panel generally designated by reference numeral 20. The backing panel is best illustrated in FIGS. 2 through 4. As illustrated the backing panel 20, especially where provided separate from the design elements 14, preferably includes a series of concavities 22 that nest within the design elements 14 of the facing panel 18. At least one aperture 24 is provided in each of the concavities 22. The backing panel 20 is preferably secured to the facing panel 18 by the cast material used to make the facing panel. More specifically, during production of a cast veneer wall panel some of the cast material preferably enters the concavities 22 through the apertures 24 (note set cast material 26 illustrated in FIG. 4 that keys the panels 18, 20 together). That cast material 26 laps around the margins of the backing panel 20 surrounding the apertures 24. When this cast material sets the backing panel 20 is securely fastened to the facing panel 18. While illustrated as two apertures 24 per concavity 22, one skilled in the art appreciates that the number of apertures 24 may be one or several, depending on the process used and the characteristics desired. In one embodiment, a single aperture 24 is substantially as large as the concavity 22 is provided, with a small flange to engage the material 26 at the top and bottom of the aperture, or around the periphery thereof, similar to that illustrated in FIG. 4.

As best illustrated in FIG. 1 the backing panel 20 includes a mounting flange 28 that projects beyond the upper edge of the facing panel 18. The mounting flange 28 may be optionally divided into identifiable zones by indentia such as the dashed line 30. The portion 32 of the mounting flange 28 above the dashed line 30 may be used by the installer to receive a nail or other fastener (not shown) to initially secure the cast veneer wall panel 10 to the underlying sheathing or studs of the building. The portion 34 below the dashed line 30 may optionally be marked e.g. "no nail below line". Alternatively the line 30 can be used to indicate a target where to nail the panel 10. In yet another embodiment one or more dashed lines may optionally be provided perpendicular to the illustrate line 30 as shown at 31 (illustrated at one mortar bed for example only), indicate lateral nail zones or "no nail" zones to avoid installation of fasteners where a fastener in an adjacent panel (below the top flange) may be installed, and may also serve as alignment features for the mortar bed area 16 of an adjacent panel. In the illustrated example, the lower flange would likely be secured between the mortar bed 16, as this would be free of fasteners in the panel installed below due to the markings 31. This notice advises the installer not to use nails in the portion 34 or 31 thereby leaving this portion free and clear of any form of fastener. In yet a further alternative, slots may be provided in the nail flange at 30 (similar to vinyl siding) as installation guides and/or to provide for installation in a manner more like siding without having to punch through material in the flange 28.

As further illustrated in FIG. 1, the backing panel 20 preferably also includes a second flange 36 that extends along the bottom and one end of the panel 10. The second flange 36 corresponds to the width of the mortar bed area 16. In addition, a series of registration marks 38 are preferably provided on the backing panel 20. In the illustrated embodiment one registration mark is provided in the mounting flange 28 and four registration marks are provided along the second flange 36. Each registration mark is preferably aligned along the centerline of an adjacent design element 14 or in the mortar bed area 16 between adjacent design elements 14, or may be provided at an edge of the design elements 14. These registration marks function to aid the installer in properly aligning the cast veneer wall panels 10 as they are secured to the side of the building to maintain the desired courseable pattern of a high quality masonry application, and may be used by an installer to cut the panel at predetermined lengths and/or positions indicated by the registration marks. In an alternative embodiment one or more of the flanges 28, 36 may be provided as part of the design elements 14 and not as part of the backer 20. In one such further embodiment, the backer is provided at the top only and the remainder of the panel is concrete; or the backer may be provided at the top of the panel 10 and/or between courses of design elements 14.

Reference is now made to FIGS. 2 and 4 which illustrate one possible embodiment of the backing panel 20 of the present invention. As illustrated, the backing panel 20 includes a front face 40 which engages the design elements 14 and a rear face 42 that is directed toward the sheathing S of the building upon installation of the wall panel 10. As illustrated, a series of stiffening ribs 44 project outwardly from the rear face 42. These ribs preferably serve to stiffen the backing panel 20 and therefore the wall panel 10 but also function upon installation to provide an offset from the sheathing S thereby providing an air gap between the rear face 42 of the backing panel 20 and the sheathing S. The stiffening ribs 44 are oriented so as to be axially aligned in a horizontal plane following installation of the wall panels 10 on the sheathing S. Breaks 45 may be provided periodically on the ribs 44 to allow drainage (and air circulation behind the panel) and prevent any accumulation of moisture on the ribs. The upper surface of the ribs 44 may slope slightly toward the breaks 45 to assist drainage. Accordingly, any moisture permeating the wall panel 10 may be drawn by gravity through the breaks 45 to an underlying weep screed (not shown) for dissipating that moisture from the building or evaporate upon air circulation.

In an alternative embodiment illustrated in FIG. 3, the rear face 40 of the backing panel 20 is provided with a series of spaced dimples 46. The dimples 46 project outwardly from the rear face 42 in the same manner as the stiffening ribs 44 in order to provide an appropriate air gap between the panel 10 and the sheathing S for moisture dissipation. Significantly, the stiffening ribs 44 or the dimples 46 may be cut down or ground down as necessary in order to compensate for any bowing or deviation in the sheathing S that might otherwise cause the wall panels 10 to seat improperly. While not illustrated, it should be appreciated that the wall panel 10 could also incorporate a combination of stiffening ribs 44 and dimples 46 if desired, or the ribs and/or dimples may be arranged in any orientation to achieve the desired properties. Furthermore, while not illustrated, the backer 20 may include a number of holes or slots to reduce the amount of material used in the backer 20.

Reference is now made to FIG. 4 illustrating the installation of one cast veneer wall panel 10 (illustrated in full line) over another cast veneer wall panel 10' previously installed to the sheathing S of a building (the previously installed panel illustrated below in phantom line). The sheathing S may be any known sheathing such as OSB, plywood, cement board, weatherproof gypsum, foam panels, etc. While not illustrated, one skilled in the art appreciates that a vapor barrier and/or weep screed may be installed over the sheathing S.

Preferably the installer first installs a starter strip at the lowest point of the wall desired to be covered, so as to provide a straight line across the surface at the bottom of the wall in a manner known to one skilled in the art. The starter strip may comprise a trim board, a flange similar to a siding starter strip, or a trim piece to resemble a course of brick or stone. Alternatively, the installer may forego the starter strip and may optionally install a piece of trim after the veneer is installed below the lowest course of the veneer along the bottom to finish the job.

Next, the first course of panel 10' is installed at the bottom of the wall. The installer then installs a second course of panel 10 by positioning the panel 10 to the top of the design elements 14' of the first course of panel 10' and aligning one of the registration marks 38 in the second flange 36 at the bottom of the wall panel 10 with the registration line 38 in the mounting flange 36 of the wall panel already installed, or may align one or more registration marks 38 with the mortar bed area 16' between design elements 14' (ref. FIG. 1) in the previously installed panel 10'. This ensures that the design elements 14 and mortar bed area 16 between the design elements provided on the wall panels 10 are properly aligned to maintain the desired regimented pattern. The bottom edge of the wall panel 10 being installed preferably rests against the top of the design elements 14' at the top of the previously installed wall panel 10'. Since the second flange 36 at the bottom of the panel 10 is of a width corresponding to the mortar bed area 16 at the top of the lower panel 10', the desired horizontal mortar bed height is maintained between rows of the design elements 14 of the two panels 10. In a similar manner, proper spacing between the design elements 14 of side-by-side wall panels 10 is also maintained by the second margin 36 as illustrated at the left side 11 of the panel 10 in FIG. 1, so as to maintain a proper vertical mortar bed 16 width between design elements 14 in adjacent panels (not shown). Although FIG. 1 illustrates the flange 36 at the left end 11 of the panel, one skilled in the art appreciates that a flange could alternatively be provided at the right end 13 of the panel, or an overlapping flange may be provided (one on each end) in a manner similar to the top and bottom flanges 36, 28' as shown in FIG. 4.

While the backer 20 is illustrated in FIGS. 2 and 3 as being substantially planar, the section of FIG. 4 illustrates the upper flange 28 as being substantially coplanar with the sheathing in FIG. 4. One skilled in the art appreciates that the upper flange 28 may also include dimples, ribs, depressions or the like so as to maintain an air gap for drainage and/or air passage (as indicated in FIGS. 2 and 3). This is illustrated in this manner in FIG. 4, to show an embodiment where the top and bottom flanges 28, 36 are designed so that the top flange 28 is in a plane below the plane of the bottom flange 36 so the overlap produces a constant thickness for the veneer installed on the wall. Alternatively the bottom flange 36 may be in a higher plane than the lower flange 28 (not illustrated). In a similar manner, the flange at the left end 11 of the panel 10 is either in a plane below the right end 13, or the right end may include a recess that would nest over the flange 36 at the left end 11 to maintain the panel 10 generally in a flat planar relationship against the sheathing S. In yet an alternative embodiment, the flange 28 includes depressions (not shown) where the panel is to be secured to the wall so as to provide for a flat mounting surface (and in this embodiment, the bottom flange is raised as described above to maintain the thickness of the panel after installation).

The wall panel 10 being installed is maintained in this desired position preferably by then driving one or more nails, screws, staples or the like through the portion 32 of the mounting flange 28 above the dashed line 30 into the underlying sheathing S. Alternatively, an adhesive or tape may be used to hold the panel in place. Additional screws or other fasteners may then be utilized to more securely fasten the wall panel 10 in position, preferably through the bottom flange 36, or in the mortar joint 16, and/or the top flange 28. Alternatively the panel 10 could be secured through the design elements 14 in a less preferred installation. More specifically, some screws may be driven through the second flange 36 at the bottom of the wall panel 10 at the point illustrated by action arrow A to tie the panels together, as well as secure both to the wall. These screws will pass freely through the second flange 36 of the upper wall panel 10 and the "no nail" portion of the mounting flange 28 of the lower panel 10 to secure both panels together, as well as to the sheathing S. Alternatively, the panels 10 may be installed with or without fasteners using an adhesive or mortar as known to one skilled in the art. Furthermore, one could use brackets to hold the panels to the sheathing as known to one skilled in the art. In a preferred embodiment, the entire mortar bed area 16 is grouted after the panels 10 are installed, as described in the Attebery application. In another embodiment, the mortar bed area 16 is finished prior to installation and the joints between panels may be filed grouted after installation, if necessary.

The backing panel 20 used in the wall panel 10 includes a main section including the concavities 22 and apertures 24. In a preferred embodiment, the body also includes the mounting flange 28 and the second flange 36 as well as stiffening ribs 44 and/or dimples 46. The backing panel 20 may be made from wood, treated wood, metal, such as steel, galvanized steel, aluminum or copper, or as a molded piece from a polymer or composite material, preferably as a single unitary molded piece. Polymer materials useful for the making of the backing panel 20 include various thermoplastic and thermoset resins, including but not limited to polyolefins, polyesters, polyvinyl chloride, polypropylene, polyethylene, polyamide, epoxy, vinyl ester, and mixtures thereof. Composite materials used to make the backing panel 20 include reinforcing material and a matrix binder. Appropriate reinforcing materials useful in the present invention include but are not limited to glass fibers, natural fibers, mineral fibers, basalt fibers, carbon fibers, kenaf fibers, jute fibers, hemp fibers, E-glass fibers, C-glass fibers, R-glass fibers, S-glass fibers, ECR-glass fibers, AR-glass fibers, polymer fibers, carbon fibers, metal fibers, other known reinforcement fibers and mixtures thereof. It should be appreciated that substantially any type of glass fiber may be used for reinforcement fibers. Glass fibers appropriate for use in the present invention may be loose chopped strand or glass mat and include those available under the trademarks Hypertex and Advantex from the assignee of the invention. Matrix binder materials useful for this purpose include but are not limited to polyolefins, polyesters, polyvinyl chloride, polypropylene, polyethylene, polyamide and mixtures thereof. The backer may be made from any known operation for the materials, for example stamping for metal, injection molding or thermoforming for thermoplastics, spray-up, compression molding or other known technique for thermosets, or may comprise a molded reinforced concrete panel.

The cast veneer wall panel 10 may be easily made by adding, pouring or spraying uncured cast material 26 such as reinforced concrete into a product mold. Next the preformed backing panel 20 is positioned onto the cast material 26, preferably prior to the setting of the cast material 26. The backing panel 20 is pressed into the cast material 26 sufficiently to force some cast material 26 through the keying apertures 24 provided in the concavities 22 in the backing panel 20. Accordingly, the concavities 22 become partially filled with cast material 26 which laps over the margins of the backing panel 20 around the apertures 24. The cast material 26 passing through the apertures 24 is fully maintained within the concavities 22 so as not to interfere with the proper seating of the panel 10 on the sheathing S when installed. As the cast material 26 sets, it effectively secures the facing panel 18 formed from the cast material 26 to the backing panel 20. At that time the method includes removing the cast veneer wall panel 10 from the mold. Alternatively, the backer 20 may include projections from the front face 40 to engage the cast material 26. In a further embodiment, the cast material 26 may be adhered to the front face 40 during hardening or after the material is hardened. In yet another embodiment, the backer 20 is molded onto the cast material 26.

While typically described as a wall veneer panel, one skilled in the art appreciates that the instant invention could be utilized in a number of other forms, such as pavers, panelized systems for fireplace surrounds, furniture, grills, and the like.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A cast veneer wall panel, comprising:

a facing panel including at least one design element, said facing panel being made from a first material; and a backing panel including (a) a series of spaced apertures wherein said series of spaced apertures receive a portion of said first material in order to key said facing panel and said backing panel together and (b) at least one concavity that nests within said at least one design element.

2. The wall panel of claim 1 wherein said first material is cast from a material selected from a group of materials consisting of concrete, reinforced concrete, gypsum, reinforced cementitious material and mixtures thereof.

3. The wall panel of claim 2, wherein said first material is reinforced with fibers selected from a group of materials consisting of glass fibers, mineral fibers, natural fibers, polymer fibers and mixtures thereof.

4. The wall panel of claim 3, wherein said glass fibers are E-glass.

5. The wall panel of claim 3, wherein said glass fibers are AR-glass.

6. The wall panel of claim 1, wherein at least one aperture of said series of spaced apertures is provided in said concavity.

7. The wall panel of claim 1, wherein said backing panel includes a mounting flange projecting beyond an edge of said facing panel.

8. The wall panel of claim 7, wherein said mounting flange is divided into identifiable zones.

9. The wall panel of claim 1, wherein said facing panel includes a mortar bed area adjacent said at least one design element.

10. The wall panel of claim 9, wherein said at least one design element provides an appearance of a wall facing material selected from a group of materials consisting of brick, stone, tile and combinations thereof.

11. The wall panel of claim 9, wherein said backing panel includes a second flange corresponding in width to said mortar bed area.

12. The wall panel of claim 1, wherein said backing panel includes a front face and a rear race, said front face engaging said facing panel.

13. The wall panel of claim 12, wherein said backing panel includes one of the group consisting of at least one stiffening rib on said rear face, a series of spaced dimples projecting from said rear face, and combinations thereof.

14. The wall panel of claim 1, wherein said cast veneer wall panel includes a registration mark on at least one of said facing panel and said backing panel.

15. The wall panel of claim 1, wherein said backing panel is made from a material selected from a group consisting of wood, metal, polymer material, composite material and mixtures thereof.

16. The wall panel of claim 15, wherein said backing panel is made from a polymer material selected from a group consisting of polyolefin, polyvinyl chloride, polypropylene, polyethylene, polyamide, epoxy, vinyl ester, polyester and mixtures thereof.

17. The wall panel of claim 15, wherein said backing panel is made from a composite material including (a) a reinforcing material selected from a group consisting of glass fibers, natural fibers, mineral fibers, basalt fibers, carbon fibers, kenaf fibers, jutte fibers, hemp fibers, E-glass fibers, C-glass fibers, R-glass fibers, S-glass fibers, ECR-glass fibers, AR-glass fibers and mixtures thereof and (b) a matrix binder selected from a group consisting of polyolefin, polyvinyl chloride, polypropylene, polyethylene, polyamide, epoxy, vinyl ester, polyester and mixtures thereof.

18. The panel of claim 10, wherein said mortar bed area is field grouted after installation of the panel.

19. A cast veneer wall panel, comprising:

a facing panel including multiple design elements, said facing panel being made from a cast material; and a backing including a series of concavities corresponding to and nesting in said multiple design elements and a series of apertures provided in said concavities;

said wall panel being characterized by a portion of said cast material passing through said series of apertures into said series of concavities and engaging a margin of said backing panel around said series of apertures so as to secure said facing panel and said backing panel together.

* * * * *